US007806770B2

(12) United States Patent
Taxon

(10) Patent No.: US 7,806,770 B2
(45) Date of Patent: Oct. 5, 2010

(54) GAMING MACHINE HAVING A MOUNTING ASSEMBLY FOR A FLAT PANEL DISPLAY

(75) Inventor: Thomas Nystrom Taxon, Reno, NV (US)

(73) Assignee: Bally Gaming, Inc., Las Vegas, NV (US)

( * ) Notice: Subject to any disclaimer, the term of this patent is extended or adjusted under 35 U.S.C. 154(b) by 539 days.

(21) Appl. No.: 11/733,196

(22) Filed: Apr. 9, 2007

(65) Prior Publication Data

US 2007/0238531 A1 Oct. 11, 2007

Related U.S. Application Data

(60) Provisional application No. 60/744,582, filed on Apr. 10, 2006.

(51) Int. Cl.
*A63F 11/00* (2006.01)

(52) U.S. Cl. ..... 463/46; 463/1

(58) Field of Classification Search ..... 463/1, 463/46; 273/138.2

See application file for complete search history.

(56) References Cited

U.S. PATENT DOCUMENTS 5,813,914 A * 9/1998 McKay et al. ..... 463/46
6,135,884 A 10/2000 Hedrick et al.
6,164,645 A * 12/2000 Weiss ..... 273/138.2
6,475,087 B1 11/2002 Cole
6,623,006 B2 * 9/2003 Weiss ..... 273/138.2
6,688,984 B2 * 2/2004 Cole ..... 463/46
6,860,814 B2 3/2005 Cole
2004/0224776 A1 * 11/2004 Nagano ..... 463/46
2006/0073900 A1 * 4/2006 Cole ..... 463/46

* cited by examiner

*Primary Examiner*—James S McClellan
*Assistant Examiner*—Ankit Doshi
(74) *Attorney, Agent, or Firm*—Steptoe & Johnson LLP

(57) ABSTRACT

A gaming machine includes a cabinet and a main door coupled to the cabinet. The main door and the cabinet define a first interior space when the main door is in a closed position. A mounting assembly is coupled to hinge of the main door. The main display is connected to the mounting assembly, wherein the main display does not move with the main door when the main door is moved from a first closed position to a second opened position, and wherein the main display is movable from a closed position to an open position independent of the main door. The mounting assembly does not require a separate hinge or mounting assembly and moves independently of the main cabinet door. The mounting assembly may be retrofitted to pre-existing gaming cabinets or installed in new gaming cabinets without any additional components thereby reducing retrofitting, manufacturing, and maintenance costs.

16 Claims, 9 Drawing Sheets

GAMING MACHINE HAVING A MOUNTING ASSEMBLY FOR A FLAT PANEL DISPLAY

CROSS-REFERENCE TO RELATED APPLICATIONS

This application claims the benefit of U.S. Provisional Application Ser. No. 60/744,582 filed Apr. 10, 2006, which is herein incorporated by reference in its entirety.

COPYRIGHT NOTICE

A portion of the disclosure of this patent document contains material that is subject to copyright protection. The copyright owner has no objection to the facsimile reproduction by anyone of the patent document or the patent disclosure, as it appears in the Patent and Trademark Office patent files or records, but otherwise reserves all copyright rights whatsoever.

BACKGROUND

Gaming machines have used various types of displays to present a game of chance to a player. Traditionally, gaming machines have used a plurality of mechanical reels having various symbols provided on the reels. However, gaming machines have increased in their complexity and player features to maintain player interest. As a result, gaming machines have been developed that use video displays such as, but not limited to, Cathode Ray Tube (CRT) monitors to present games of chance. While useful, CRT monitors use a large amount of space within the gaming machine cabinet.

In addition to CRT monitors, flat panel displays, such as LCD or plasma displays, have also been used in gaming machines. While these flat panel displays occupy less space within the gaming machine, the mounting locations of these displays within a gaming cabinet inhibit access or block portions of the gaming cabinet. Accordingly, the flat panel display needs to be removed from the gaming cabinet to access portions of the gaming cabinet, thereby increasing the complexity and costs of maintaining a gaming machine. What is needed are mounting assemblies that allow a flat panel display to be viewable by a player to provide easier access to the interior of the gaming machine cabinet.

SUMMARY

Briefly, and in general terms, various embodiments are directed to a gaming machine having a mounting assembly for a flat panel display. According to one embodiment, the gaming machine includes a cabinet and a main door coupled to the cabinet. The main door and the cabinet define a first interior space when the main door is in a closed position. A mounting assembly is coupled to hinge of the main door. The main display is connected to the mounting assembly, wherein the main display does not move with the main door when the main door is moved from a first closed position to a second opened position, and wherein the main display is movable from a closed position to an open position independent of the main door. The mounting assembly does not require a separate hinge or mounting assembly and moves independently of the main cabinet door. The mounting assembly may be retrofitted to pre-existing gaming cabinets or installed in new gaming cabinets without any additional components thereby reducing retrofitting, manufacturing, and maintenance costs.

In another embodiment, the gaming machine includes a main door coupled to the cabinet via a hinge. The main door and the cabinet define a first interior space when the main door is in a closed position. A mounting assembly coupled to the hinge of the main door, and a main display is connected to the mounting assembly. The main display does not move with the main door when the main door is moved from a first closed position to a second opened position, and the main display is movable from a closed position to an open position independent of the main door. The gaming machine also includes a top box positioned above the cabinet and a secondary door is pivotally coupled to the top box. The secondary door and the top box define a second interior space when the secondary door is in a closed position. According to one embodiment, the second interior space is separate and apart from the first interior space. In this embodiment, the secondary display is mounted to the secondary door. The secondary display is movable with the secondary door when the secondary door is moved from a closed position to an opened position.

In yet another embodiment, the gaming machine includes a cabinet defining an interior space. A main door having an opening is coupled to the cabinet via a hinge, and a plurality of mechanical reels are visible through the opening of the main door. The gaming machine also includes a top box positioned above the main cabinet. A secondary door having an opening is pivotally coupled to the top box via a hinge. The secondary door and the top box define a second interior space when the secondary door is in a closed position. The second interior space is separate and apart from the first interior space. A mounting assembly coupled to the hinge to move a flat panel display from an operational position to a service position, wherein the flat panel display is visible through the opening in the operational position and the flat panel is moved away from the interior space of the top box in the service position. The mounting assembly prevents the flat panel display from moving with the secondary door when the secondary door is moved from a first closed position to a second opened position.

Other features and advantages will become apparent from the following detailed description, taken in conjunction with the accompanying drawings, which illustrate by way of example, the features of the various embodiments.

DETAILED DESCRIPTION

Briefly, and in general terms, various embodiments are directed to a gaming machine having a mounting assembly for a flat panel display. The mounting assembly allows a flat panel display to be viewable through an opening in the main door. Additionally, the mounting assembly allows the flat panel display to move between an open position and a closed position, independent of the main door, thereby providing easier access to the interior of the gaming cabinet. Furthermore, the mounting assembly uses the hinges of the main door to minimize manufacturing or retrofitting costs.

Figure 1:
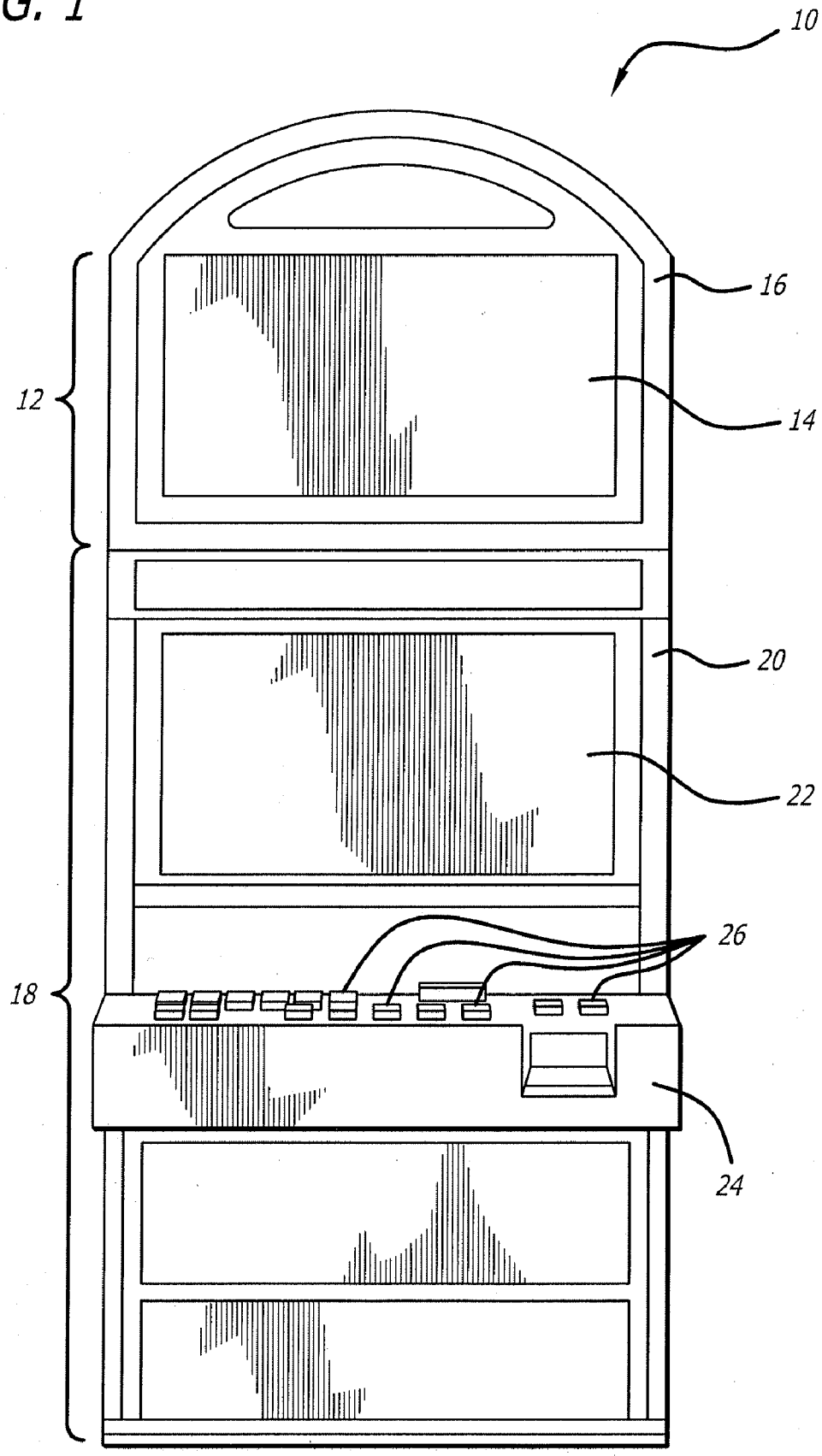
FIG. 1 is a front view of one embodiment of a gaming machine having a flat panel display.

Referring now to the drawings, wherein like reference numerals denote like or corresponding parts throughout the drawings and, more particularly to FIGS. 1-9, there are shown various embodiments of a gaming machine having a movable display screen. More specifically, FIG. 1 illustrates one embodiment of a gaming machine 10 having a movable flat panel display. The gaming machine 10 includes a top box 12 and a main cabinet 18. A top box door 16 secures the interior of the top box 12, and a main door 20 that secures the interior of the main cabinet 18. The top box 12 and main cabinet 18 include video display screens 14 and 22, respectively. The main cabinet 18 also includes a button deck 24 that includes a plurality of buttons 26 needed to properly operate the provided games on the gaming machine 10. In still other embodiments, a single reconfigurable button may be used in lieu of or in addition to the bottom deck 24.

In the embodiment shown in FIG. 1, the video display screen 14 of the top box 12 displays game information. The game information may be a pay table, animation or graphics relating to the name or theme of the game, one or more bonus games, a progressive meter, or other information pertinent to the game presented on the main display 22. Alternatively, the video display screen 14 may present other information such as, but not limited to, gaming-related information, news, and advertisements. The gaming-related information may include, for example, information on sports betting and various betting options relating to sporting events. Additionally, the gaming-related information may include other gaming type information, such as horse racing and off-track betting. News and advertisements such as, but not limited to, casino attractions, show times, restaurant and hotel specials, and world events may also be presented on the display screen or any display screen on the gaming machine.

As shown in FIG. 1, the main display 22 presents one or more games of chance such as, but not limited to, video slots, video keno, video poker, video blackjack, video roulette, or Class II bingo. In alternate embodiments, the game display 22 may present games of skill or games of chance involving some player skill. In one embodiment, the game display 22 is a flat panel display, including by way of example only, and not by way of limitation, liquid crystal, plasma, electroluminescent, vacuum fluorescent, field emission, LCOS (liquid crystal on silicon), and SXRD (Silicon Xtal Reflective display), or any other type of panel display known or developed in the art. These flat panel displays may use panel technologies to provide digital quality images, including by way of example only, and not by way of limitation, EDTV, HDTV, or DLP (Digital Light Processing). Additionally, the game display 22 may also include a touch screen or touch glass system (not shown), as is well known in the art.

One of ordinary skill in the art will appreciate that not all gaming machines have all these components and that each gaming machine may have other components in addition to, or in lieu of, those components mentioned here. Furthermore, while these components are viewed and described separately, various components may be integrated into a single unit in some embodiments.

Figure 2:
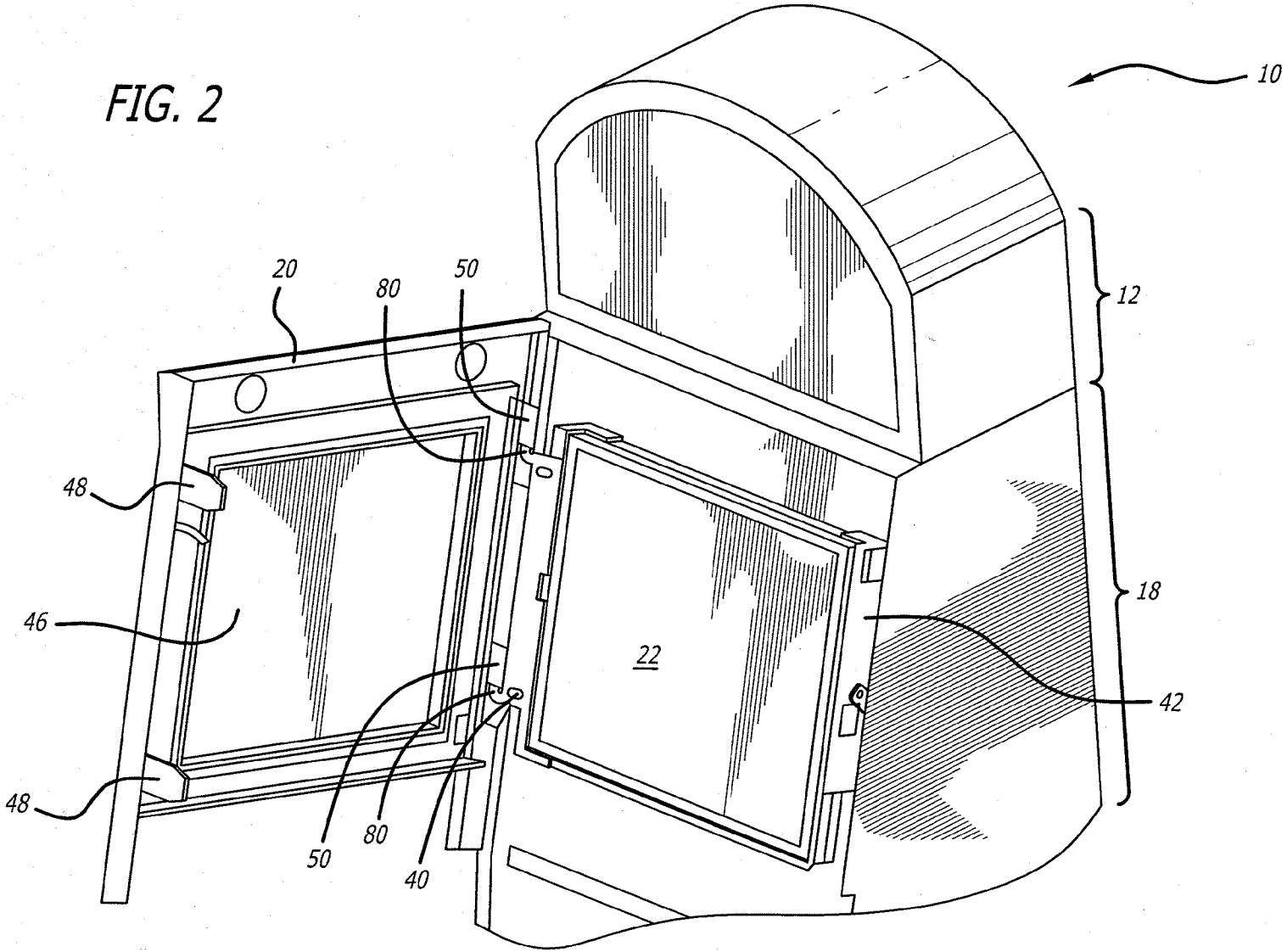
FIG. 2 is a perspective view of the gaming machine of FIG. 1 having the gaming cabinet door opened and the flat panel display in an operating position.

FIG. 2 illustrates one embodiment of the gaming machine 10 in which the main door 20 has been opened to expose the interior of the gaming machine. As shown in FIG. 2, the main display 22 is fixed in an operating position. In the operating position, the main display 22 is located within the gaming machine 10 such that the display is positioned over a portion of the interior of the main cabinet 18 and is viewable through the display opening 46 of the main cabinet door 20 when the main cabinet door is in a closed position. Additionally, the guide members 48 act as a stop to prevent the main display 22 from hitting the main door opening 46. As shown in FIG. 2, the main cabinet door 20, optionally, includes one or more guide members 48 that align the main door opening 46 with the main display 22.

As shown in FIG. 2, the main display 22 is movably coupled to the hinges 50 of gaming machine 10 via a display mount 40. According to one embodiment, the display mount 40 includes one or more hinges 80 coupled to a frame. The frame is shaped and sized to correspond to the shape and size of the main display 22. In an alternate embodiment, the hinges 80 are directly coupled to the main display 22.

Figure 3:
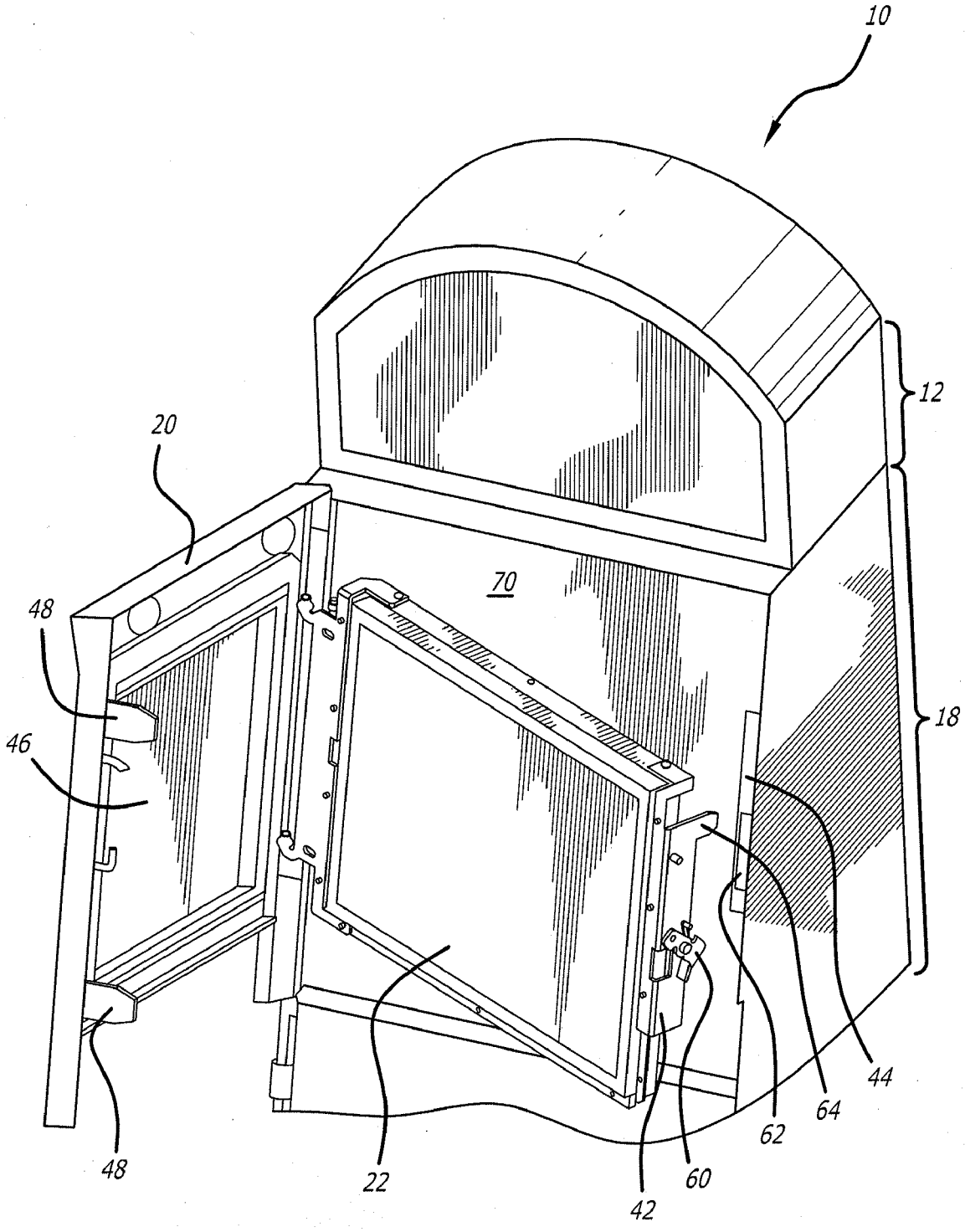
FIG. 3 is a perspective view of the gaming machine of FIG. 2, wherein the flat panel display is in an intermediate position.
Figure 4:
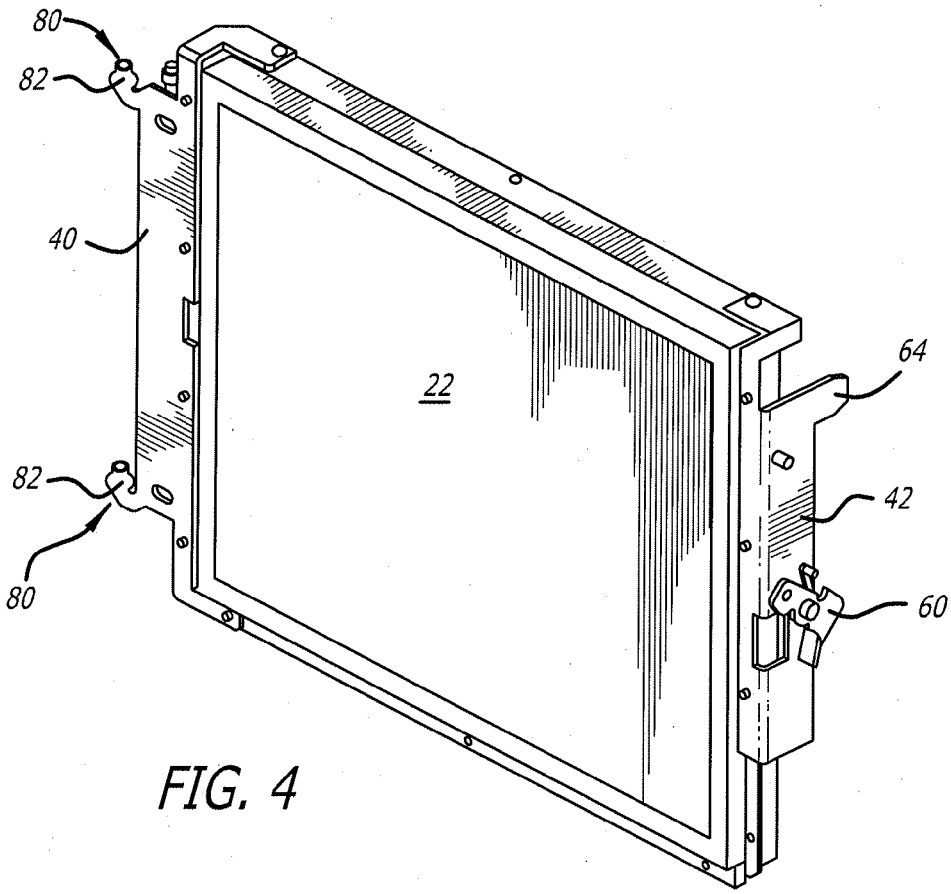
FIG. 4 is a perspective view of one embodiment of the mounting assembly coupled to a flat panel display.

As shown in FIGS. 2-4, the display mount 40 includes two hinges 80, but other embodiments of the display mount 40 may include one or more hinges. For example, a display mount (not shown) having a single hinge may used for a main display 22 that is relatively small and/or light weight. Alternatively, a display mount (not shown) may have three or more hinges for a main display that is large and/or heavy.

In another embodiment, the display mount 40 includes a latch structure 42 that is located opposite the hinges 80 as shown in FIG. 4. According to one embodiment, the latch structure 42 is coupled to or integral with the frame of the display mount 40. Alternately, the latch structure 42 is directly coupled to the display 22. The latch structure 42 is configured to engage a bracket 44 that is positioned on the main cabinet 18. As a result, the main display 22 is secured in the operating position by a latch structure 42 positioned on the frame of the main display 22. The latch structure 42 prevents the main display 22 from inadvertently moving when the main cabinet door 20 is opened.

Referring back to FIG. 3, the display mount 40 is shown in a service position. In the service position, the main display 22 is moved away from the interior of the main cabinet 18 thereby allowing for better access to components within the main cabinet. While FIG. 3 illustrates the main display 22 moved slightly away from the interior of the main cabinet 18, the main display may be moved to any position spaced away from the interior of the main cabinet. When the main display 22 is moved into the service position, components (not shown) in the interior 70 of the main cabinet 18 are more accessible by casino technicians.

According to one embodiment, when the display mount in is the service position, the main display 22 engages the main door 20 of the cabinet 18 via the guide members 48. More specifically, the edges of the display mount 40 engage guide members 64 on the main door via friction fit. The guide members 64 are long enough to prevent the display screen 22 from contacting the main door 20. In this configuration, the display 22 is movable into a position that provides better access to the interior of the main cabinet 18. Additionally, in this configuration, when the main door is moved from the open position to the closed position, the main display 22 moves with the main door 20. When the main door 20 is completely closed, the display mount latch 60 engages the slot 62 of the main cabinet 18. Accordingly, when the main door 20 is subsequently opened, the display screen 22 is securely mounted in the operating position.

Figure 5:
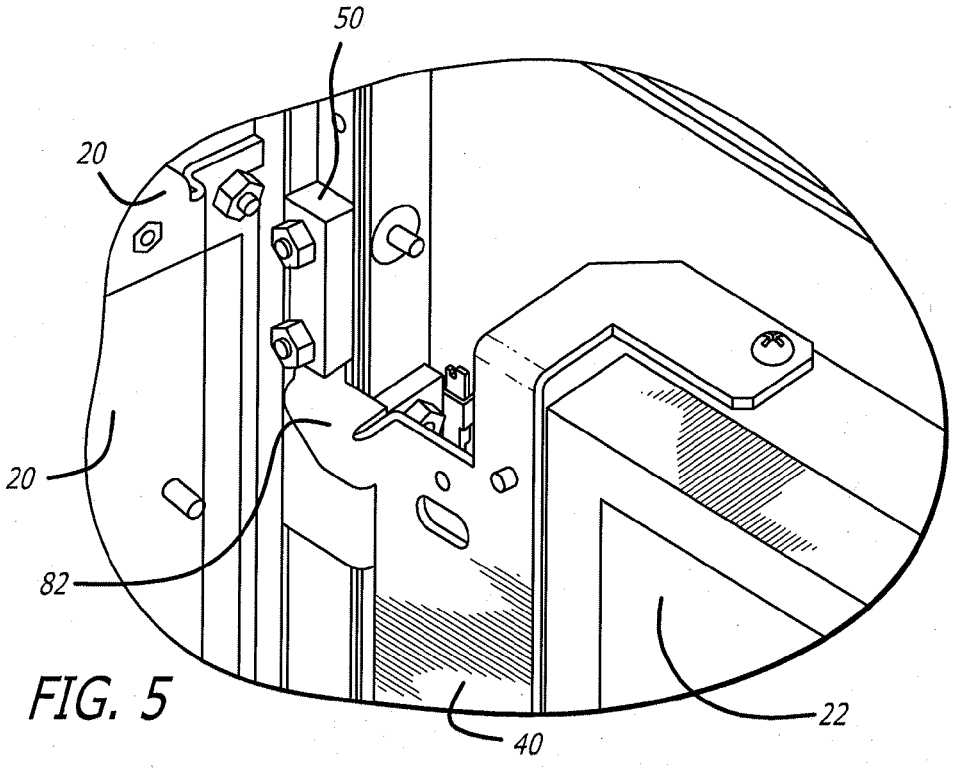
FIG. 5 is an enlarged perspective view of the mounting assembly of FIG. 4 coupled to the hinge of the main cabinet door.
Figures 6, 7:
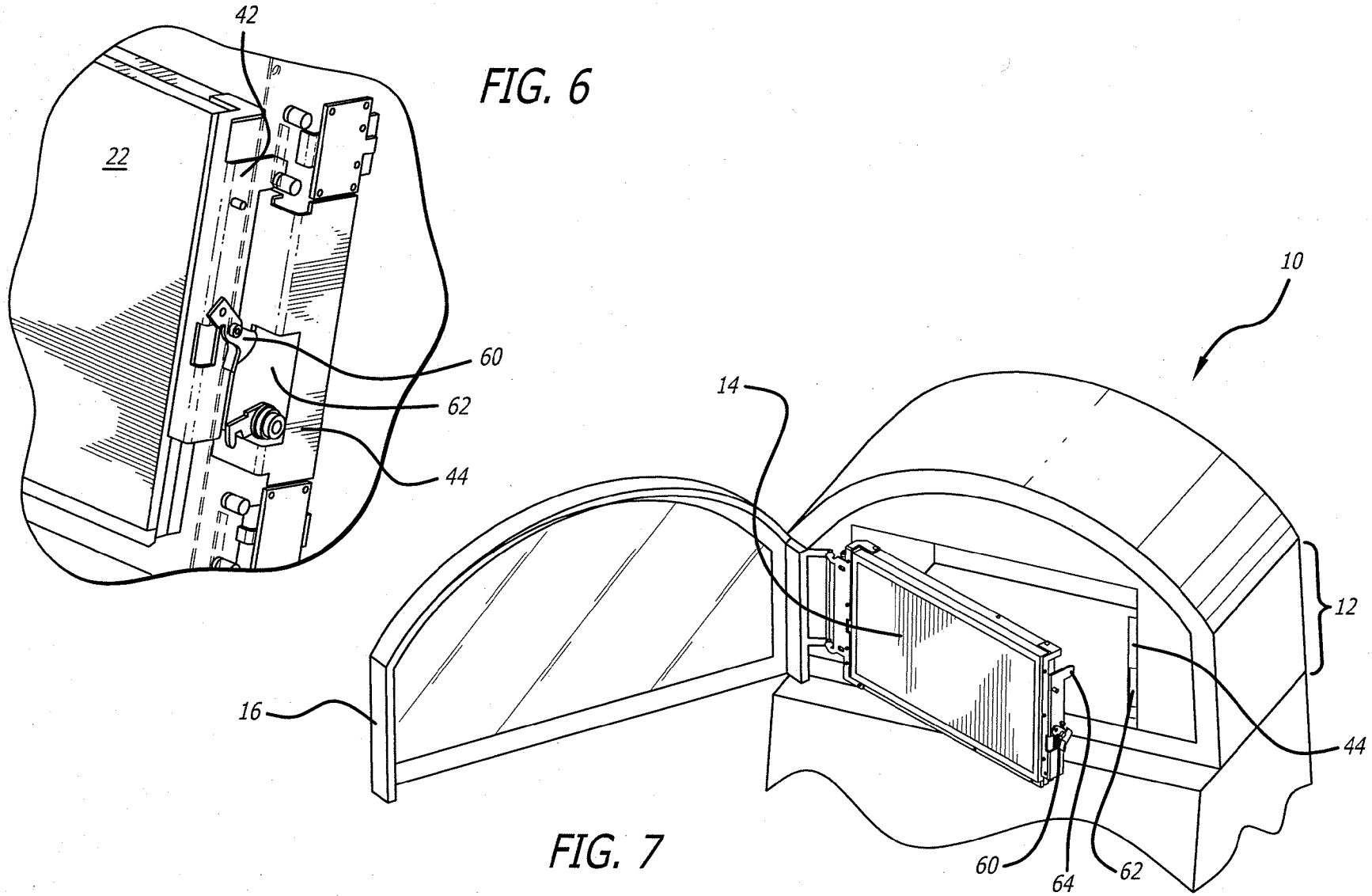
FIG. 6 is a perspective view of one embodiment of the latch structure for the mounting assembly.
FIG. 7 is a perspective view of another embodiment of a gaming machine having flat panel mounting assembly positioned in the top box of the gaming machine.

FIGS. 4-6 illustrate one embodiment of a display screen 22 having a mounting assembly 42 including a hinge 80 and a latch structure 42. These structures 80 and 42 are secured to the frame of a display assembly via screws, rivets, or other fasteners known or developed in the art. As shown in FIG. 4, the structures 80 and 42 are positioned on opposite ends of the display screen 22. In other embodiments, the latch structure 42 may be positioned on either the top or bottom edges of the display screen 22. FIG. 5 is enlarged perspective view showing one extending bracket 82 of the display mount 40 that is coupled to the hinge 80 for the main door 20. Because the main display 22 is coupled to the hinge 80, the display is able to move from the operating position to a service position where the display 22 is moved away from the opening of the main cabinet 18.

As shown in FIG. 6, the latch 60 is pivotally attached to the latch structure 42. In alternate embodiments, the latch 60 may be spring loaded or include one or more cams to secure the latch within the slot 62. The hinge structure 80 includes two extending bracket 82 that include openings that are designed to align with and be secured to the hinge of the main door. As those skilled in the art will appreciate, the length of the extending bracket 82 and/or the width of the display mount 40 may be altered to center the display screen 22 within the gaming machine and the opening 46 of the main door 20. According to one embodiment, the latch structure 42 and the display mount 40 are directly fixed to the display screen 22. Alternatively, the display 22 may be mounted to a frame (not shown) which, in turn, is fixed to the display mount 40 and the latch structure 42.

Referring back to in FIG. 1, the gaming machine 10 comprises a main cabinet 18, a main door 20, a top box 12, and a door 16 associated with the top box. The gaming machine includes a main display 22 and a secondary display 14. The main display 22 is mounted to the main cabinet 18 via the display mount 40, as discussed above. Thus, the main display 22 is not mounted to the main door 20 and does not move with the main door when the main door moves from a closed position to an opened position.

According to one embodiment, the top box 12 is partitioned from the main cabinet 18 such that the top box door 16 defines an interior space along with the top box that is separate and apart from the interior space of the cabinet 18. In this embodiment, the secondary display 14 is mounted to the door 16 of the top box 12 such that the secondary display is viewable through an opening of the top box door. The secondary display 14 may be secured to the door 16 with screws, rivets, friction fitted into place via a bracket on the door and the display, or snap-fitted into position on the door. According to one embodiment, the secondary display 14 is directly fixed to the door surface. In another embodiment, the secondary display 14 may include a frame and/or one or more brackets that are secured to the display, and the frame and/or brackets are used to secure the display to the interior surface of the top box door 16. Additionally, the interior surface of the top box door 16 may include one or more brackets that may be used to secure the display 14 to the interior surface of the top box door. In short, in this embodiment, the main display 22 is hingedly mounted to the cabinet 18, while the secondary display 14 is mounted to the top box door 16. Both the main cabinet 18 and the top box 12, along with their respective doors 20 and 16, form separate and distinct interior spaces.

In yet another embodiment, the gaming machine (not shown) comprises a main cabinet, a main door, and a main display. This gaming machine is similar to the gaming machine depicted in FIGS. 1-3 except the gaming machine does not include a top box. Likewise, if the gaming machine was to include a top box, it does not include a video display. The main display is mounted to the main cabinet via the display mount 40, as discussed above. Therefore, the main display is not mounted to the main door and does not move with the main door when the main door moves from a closed position to an opened position.

Figure 8:
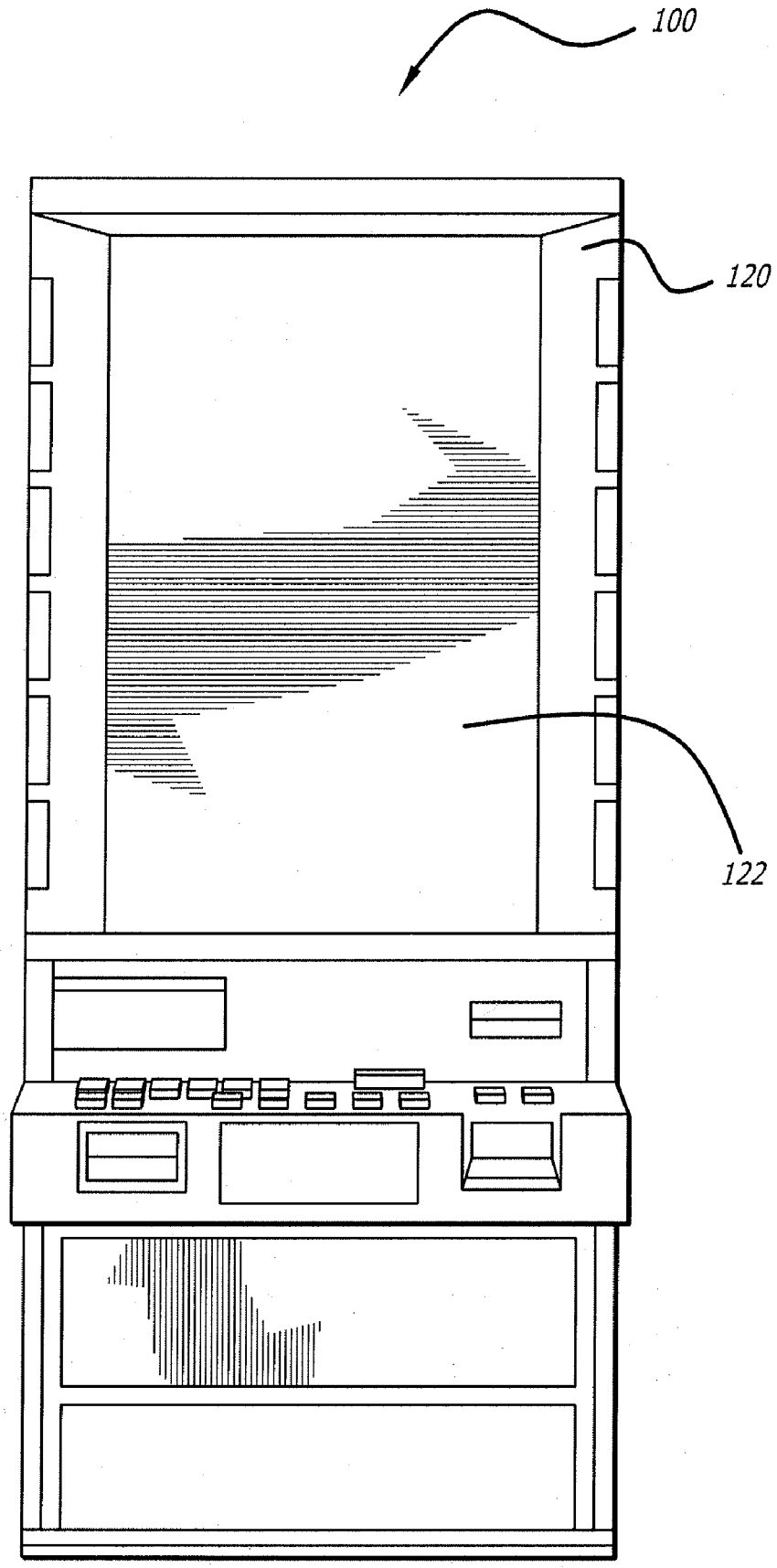
FIG. 8 is a front view of yet another embodiment of a gaming machine having a flat panel mounting assembly for a flat panel display mounted in a portrait orientation.
Figure 9:
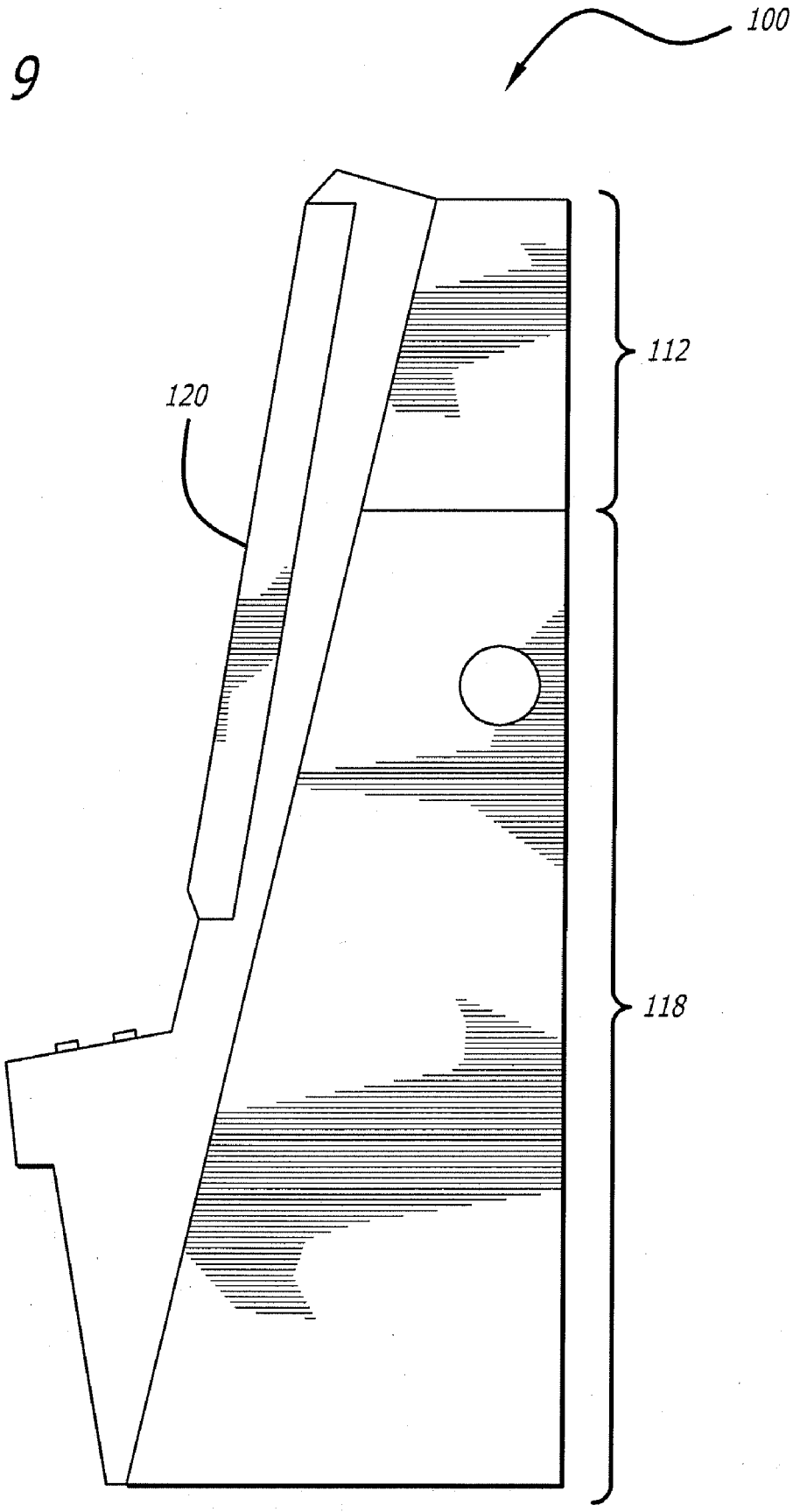
FIG. 9 is a perspective view of another embodiment of a gaming machine having mechanical reels and a secondary video display.

In the embodiment depicted in FIGS. 8-9, the gaming machine 100 comprises a main cabinet 118, and a main door 120 that encloses the interior space of the main cabinet. According to one embodiment, a wide screen display 122 is mounted in a portrait orientation. The main display 122 is mounted to the main cabinet 118 via the display mount 40, as discussed above. Hence, the main display 122 is not mounted to the main door 120 and does not move with the main door when the main door moves from a closed position to an opened position.

In another embodiment, a gaming machine having a main cabinet and top box is retrofitted to accommodate a flat panel display in the main cabinet area, top box area, or both areas of the gaming machine. For example, according to one embodiment, a wide screen display as shown in FIG. 8 is retrofitted to a gaming machine. A new main door is hung on the existing hinges of the main cabinet (and optionally the top box). Additionally, the wide screen display is mounted to the main cabinet 118 via the hinge and bracket structure 40 and 44, as discussed above. As such, the main display 122 is not mounted to the main door 120 and does not move with the main door when the main door moves from a closed position to an opened position.

Figure 10:
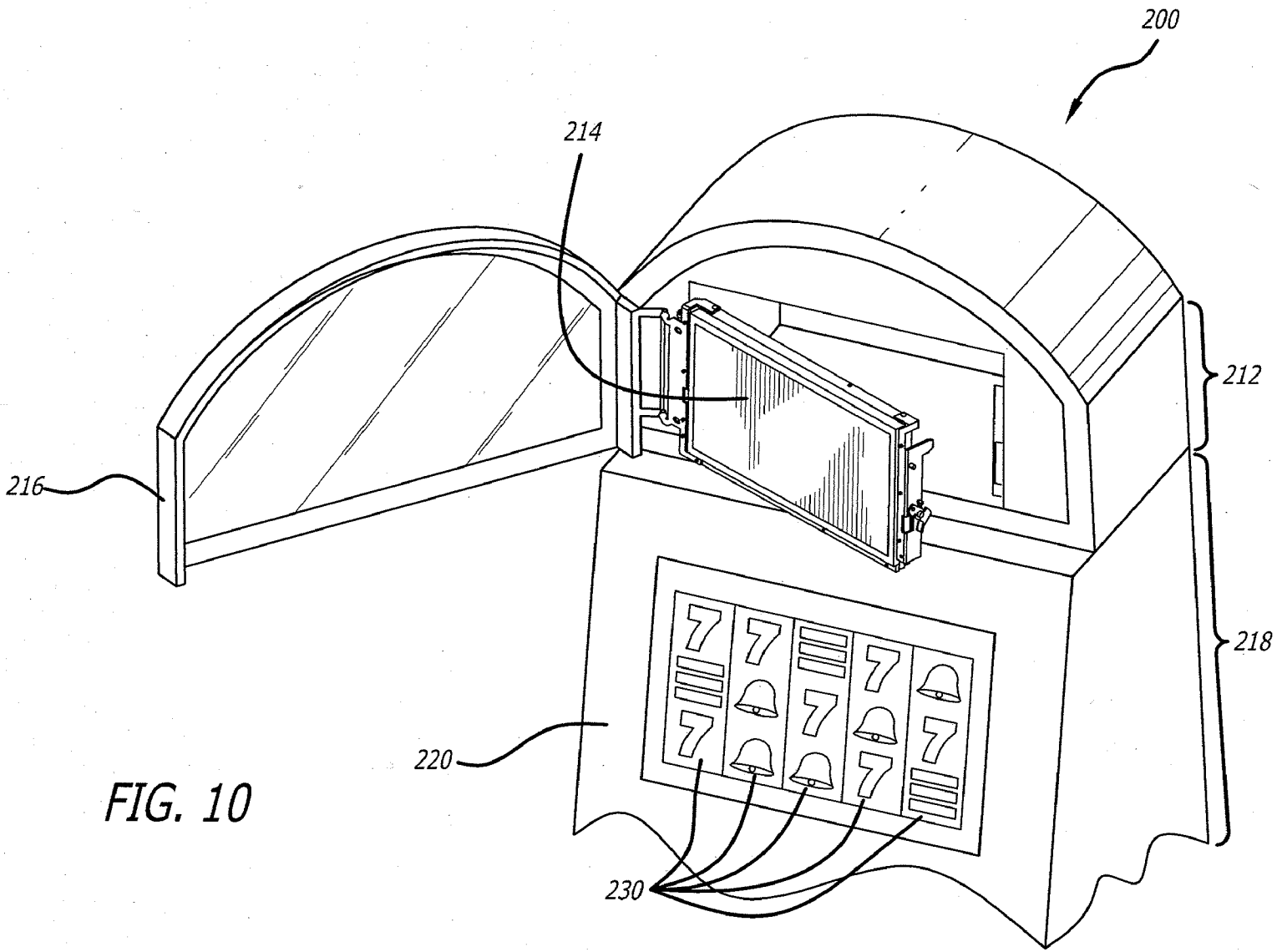
FIG. 10 is a perspective view of a gaming machine with a top box door opened and a flat panel display in an intermediate position.

As shown in FIG. 10, the gaming machine 200 includes a main cabinet, a main door 220, a plurality of mechanical reels 230 visible through the main door, a top box 212, and a top box door 216. A video display 214 is included in the top box 212 and is visible through the top box door 216. The video display 214 is mounted to the top box door 216. The top box 212 is partitioned from the main cabinet 218 such that the top box door 216 defines an interior space along with the top box 212 that is separate and apart from the interior space of the main cabinet 218.

Figure 11:
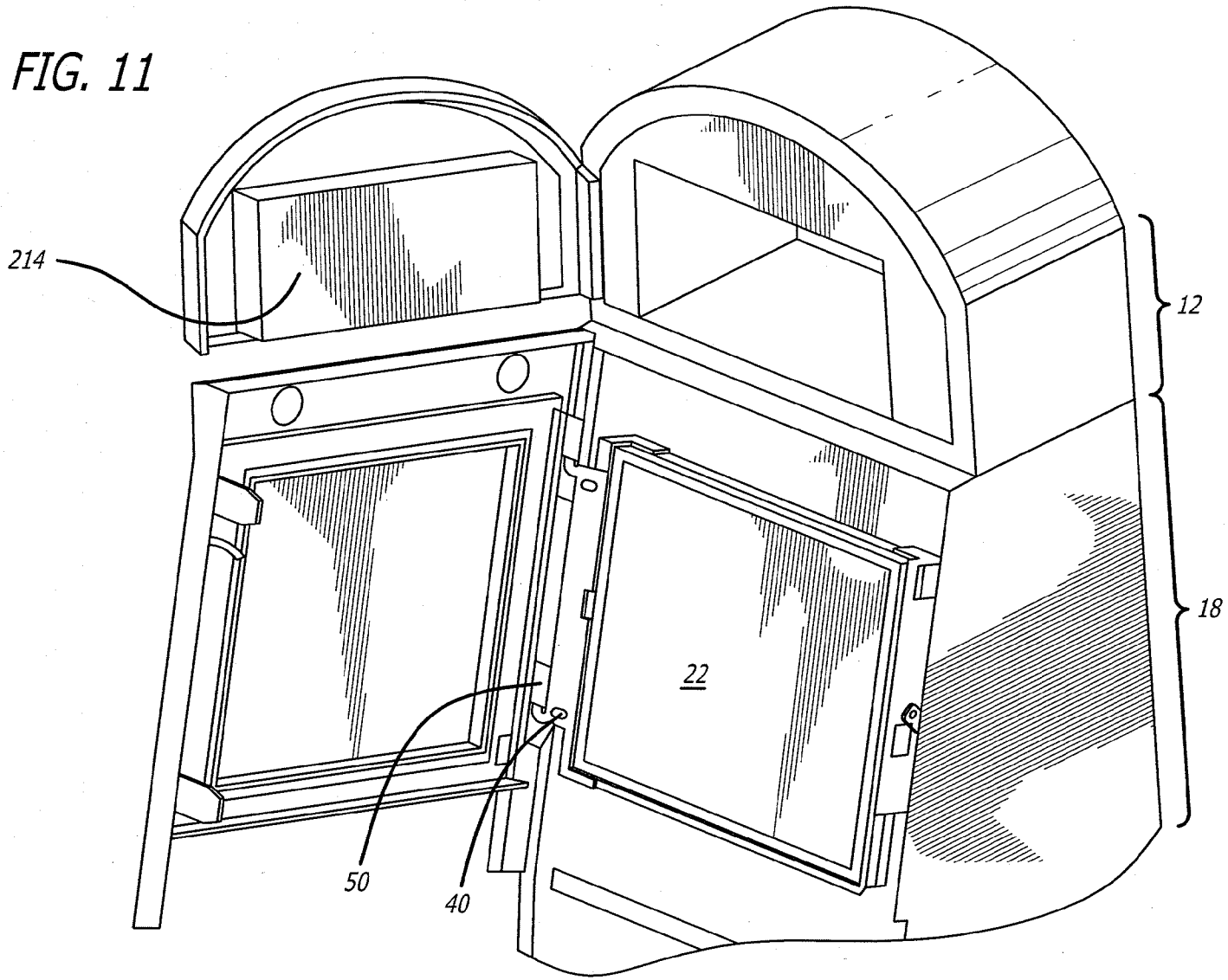
FIG. 11 is a perspective view of a gaming machine with a gaming cabinet door and a top box door opened, wherein a flat panel display is mounted to the top box door and a main display is in an operating position.

In another embodiment, the top box (not shown) may be an integral portion of the main cabinet. Accordingly, the main door (not shown) may enclose both the top box area and the main cabinet. Additionally, the wide screen display is mounted to the main cabinet via the display mount 40, as discussed above. As such, the main display 40 is not mounted to the main door and does not move with the main door when the main door moves from a closed position to an opened position. In one embodiment, a secondary video display 214 is visible through the top box 212 and may be directly mounted to the top box door 216, as shown in FIG. 11. Alternatively, the secondary video display may be mounted within the area of the top box via the display mount 40 as discussed above and shown in FIG. 10.

The various embodiments described above are provided by way of illustration only and should not be construed to limit the claimed invention. Those skilled in the art will readily recognize various modifications and changes that may be made to the claimed invention without following the example embodiments and applications illustrated and described herein, and without departing from the true spirit and scope of the claimed invention, which is set forth in the following claims.

What is claimed:

1. A gaming machine, comprising:

a cabinet;

a main door coupled to the cabinet via a hinge having an axis of rotation, wherein the main door and the cabinet define a first interior space when the main door is in a closed position;

a mounting assembly including a frame and at least one bracket extending from the frame, wherein the bracket is coupled to the hinge of the main door, wherein the mounting assembly pivots about the same axis of rotation as the hinge;

the main display connected to the frame of the mounting assembly, wherein the main display does not move with the main door when the main door is moved from a first closed position to a second opened position, and wherein the main display is movable from a closed position to an open position independent of the main door;

a top box positioned above the cabinet;

a secondary door pivotally coupled to the top box, wherein the secondary door and the top box define a second interior space when the secondary door is in a closed position, and wherein the second interior space is separate and apart from the first interior space; and a secondary display mounted to an inner surface of the secondary door, wherein the secondary display is movable with the secondary door when the secondary door is moved from a first closed position to a second opened position.

2. The gaming machine of claim 1, wherein the main display is positioned in a portrait orientation.

3. The gaming machine of claim 1, wherein the main display is a widescreen, flat panel display.

4. The gaming machine of claim 1, wherein the mounting assembly further comprises a latch assembly that secures the main display in a closed position when the main door is opened.

5. The gaming machine of claim 4, wherein the latch assembly further comprises a latch pivotally coupled to the mounting assembly and a receiving structure that engages the latch, wherein the receiving structure is coupled to the cabinet.

6. A gaming machine, comprising:

a main cabinet;

a main door coupled to the main cabinet by a hinge having an axis of rotation, wherein the main door and the main cabinet define a first interior space when the main door is in a closed position;

a mounting assembly including a frame and at least one bracket extending from the frame, wherein the bracket is coupled to the hinge of the main door, and wherein the mounting assembly and the main door pivot about the same axis of rotation; and a main display connected to the mounting assembly, wherein the main display does not move with the main door when the main door is moved from a first closed position to a second opened position, and wherein the main display is movable from a closed position to an open position independent of the main door.

7. The gaming machine of claim 6, further comprising:

a top box positioned above the main cabinet;

a secondary door pivotally coupled to the top box, wherein the secondary door and the top box define a second interior space when the secondary door is in a closed position, and wherein the second interior space is separate and apart from the first interior space; and a secondary display mounted to an inner surface the secondary door, wherein the secondary display is movable with the secondary door when the secondary door is moved from a first closed position to a second opened position.

8. The gaming machine of claim 6, further comprising a mounting assembly attached to the main display, wherein the mounting assembly is coupled to the hinge of the cabinet.

9. The gaming machine of claim 8, wherein the mounting assembly further comprises a latch assembly that secures the main display in a closed position when the main door is opened.

10. The gaming machine of claim 9, wherein the latch assembly further comprises a latch pivotally coupled to the mounting assembly and a receiving structure that engages the latch, wherein the receiving structure is coupled to the cabinet.

11. The gaming machine of claim 6, further comprising:

a top box positioned above the cabinet;

a secondary door pivotally coupled to the top box, wherein the secondary door and the top box define a second interior space when the secondary door is in a closed position, and wherein the second interior space is separate and apart from the first interior space; and a secondary display hingedly connected to the top box such that the secondary display does not move with the secondary door when the secondary door is moved from the closed position to an opened position.

12. The gaming machine of claim 11, further comprising a secondary mounting assembly attached to the main display, wherein the secondary mounting assembly is coupled to a hinge of the top box.

13. The gaming machine of claim 12, wherein the mounting assembly further comprises a latch assembly that secures the main display in a closed position when the main door is opened.

14. The gaming machine of claim 13, wherein the latch assembly further comprises a latch pivotally coupled to the mounting assembly and a receiving structure that engages the latch, wherein the receiving structure is coupled to the cabinet.

15. A gaming machine, comprising:

a cabinet defining an interior space;

a main door coupled to the cabinet via a hinge having an axis of rotation, wherein the main door includes an opening;

a plurality of mechanical reels visible through the opening of the main door;

a top box positioned above the main cabinet;

a secondary door having an opening, wherein the secondary door is pivotally coupled to the top box via a hinge, wherein the secondary door and the top box define a second interior space when the secondary door is in a closed position, and wherein the second interior space is separate and apart from the first interior space; and a mounting assembly including a frame and at least one bracket extending from the frame, wherein the bracket is coupled to the hinge to move the flat panel display from an operational position to a service position, wherein the main door and the mounting assembly have the same axis of rotation, wherein the flat panel display is visible through the opening in the operational position and the flat panel is moved away from the interior space of the top box in the service position, and wherein the mounting assembly prevents the flat panel display from moving with the secondary door when the secondary door is moved from a first closed position to a second opened position.

16. The gaming machine of claim 15, wherein the mounting assembly further comprises a latch assembly that secures the flat panel display in the operation position when the secondary door is opened.

* * * * *